US010415495B2

(12) United States Patent
Behrendt

(10) Patent No.: US 10,415,495 B2
(45) Date of Patent: Sep. 17, 2019

(54) METHOD FOR REGULATING A FUEL DELIVERY SYSTEM

(71) Applicant: Continental Automotive GmbH, Hannover (DE)

(72) Inventor: Gerald Behrendt, Frankfurt am Main (DE)

(73) Assignee: Continental Automotive GmbH, Hannover (DE)

( * ) Notice: Subject to any disclaimer, the term of this patent is extended or adjusted under 35 U.S.C. 154(b) by 10 days.

(21) Appl. No.: 15/569,657

(22) PCT Filed: Apr. 25, 2016

(86) PCT No.: PCT/EP2016/059172
§ 371 (c)(1),
(2) Date: Oct. 26, 2017

(87) PCT Pub. No.: WO2016/173983
PCT Pub. Date: Nov. 3, 2016

(65) Prior Publication Data

US 2018/0112620 A1 Apr. 26, 2018

(30) Foreign Application Priority Data

Apr. 27, 2015 (DE) ..... 10 2015 207 705

(51) Int. Cl.

| | |
|---|---|
| ***F02D 41/00*** | (2006.01) |
| ***F02D 41/30*** | (2006.01) |
| ***F02D 41/24*** | (2006.01) |
| ***F02D 33/00*** | (2006.01) |
| ***F02M 37/08*** | (2006.01) |
| ***F04B 49/06*** | (2006.01) |
| *F02D 41/12* | (2006.01) |

(52) U.S. Cl.
CPC ..... *F02D 41/3082* (2013.01); *F02D 33/003* (2013.01); *F02D 41/2409* (2013.01);
(Continued)

(58) Field of Classification Search
CPC ..... F02D 2200/0604; F02D 2200/0614; F02D 41/3082; F02D 41/123; F02D 41/2409;
(Continued)

(56) References Cited

U.S. PATENT DOCUMENTS 4,940,034 A * 7/1990 Heim ..... F02D 41/3082 123/198 D
2002/0088437 A1* 7/2002 Ricco ..... F02B 67/00 123/457

(Continued)

FOREIGN PATENT DOCUMENTS

CN 102562384 7/2012
DE 38 00 177 A1 7/1989

(Continued)

*Primary Examiner* — Hieu T Vo
*Assistant Examiner* — Sherman D Manley
(74) *Attorney, Agent, or Firm* — Cozen O'Connor

(57) ABSTRACT

A method for regulating a fuel delivery system of an internal combustion engine in a motor vehicle having a fuel delivery pump for supplying the internal combustion engine with fuel, the fuel delivery pump having a pump mechanism driveable by an electric motor actuable by a control signal, and a pressure-sensor-free pressure monitor being provided in the fuel delivery system, includes: predefining a target rotational speed for the electric motor based on the control signal; predefining an upper rotational speed limit and/or a lower rotational speed limit for the target rotational speed, wherein the upper rotational speed limit depends on the maximum fuel requirement of the internal combustion engine, and the lower rotational speed limit depends on the minimum fuel requirement of the internal combustion engine; and determining the target rotational speed by a pressure-sensor-free calculation method.

12 Claims, 3 Drawing Sheets

(52) U.S. Cl.
CPC ..... *F02M 37/08* (2013.01); *F04B 49/065* (2013.01); *F02D 41/123* (2013.01); *F02D 2200/0604* (2013.01); *F02D 2200/0614* (2013.01); *F02D 2250/31* (2013.01); *F04B 2203/0209* (2013.01)

(58) Field of Classification Search
CPC .. F02D 33/003; F02D 2250/31; F04B 49/065; F04B 2203/0209; F02M 37/08
See application file for complete search history.

(56) References Cited

U.S. PATENT DOCUMENTS

| | | | | |
|---|---|---|---|---|
| 2010/0116253 | A1* | 5/2010 | Furuhashi | F02M 37/46 123/495 |
| 2011/0238282 | A1* | 9/2011 | Saruwatari | F02D 41/2438 701/103 |
| 2012/0156057 | A1* | 6/2012 | Akita | F02D 41/3082 417/44.2 |
| 2016/0153389 | A1* | 6/2016 | Lana | F02D 41/401 123/447 |
| 2016/0265471 | A1* | 9/2016 | Graf | F02D 41/3082 |
| 2017/0314548 | A1* | 11/2017 | Graf | F02M 37/08 |

FOREIGN PATENT DOCUMENTS

| | | | |
|---|---|---|---|
| DE | 10 2008043127 | A1 | 4/2010 |
| DE | 10 2009 045 457 | A1 | 5/2010 |
| DE | 10 2013 220 488 | A1 | 4/2015 |
| WO | WO 2015 055666 | A1 | 4/2015 |

* cited by examiner

METHOD FOR REGULATING A FUEL DELIVERY SYSTEM

CROSS-REFERENCE TO RELATED APPLICATIONS

This is a U.S. national stage of application No. PCT/EP2016/059172, filed on 25 Apr. 2016, which claims priority to the German Application No. 10 2015 207 705.5 filed 27 Apr. 2015, the content of both incorporated herein by reference.

BACKGROUND OF THE INVENTION

1. Field of the Invention

The invention relates to a method for regulating a fuel delivery system of an internal combustion engine in a motor vehicle.

2. Related Art

The fuel delivery system in motor vehicles having an internal combustion engine must ensure sufficient fuel delivery for a large number of operating states of the motor vehicle to ensure fault-free operation of the motor vehicle. Also, different variants of the internal combustion engines increase the required flexibility.

For the regulation of the fuel delivery system and in particular of the fuel delivery pump, use is made of regulators which can influence the delivered fuel volume, the pressure in the fuel delivery system and the rotational speed of the fuel delivery pump. For this purpose, the regulators have suitable control behavior and, in particular, also good disturbance behavior to compensate sufficiently for disturbance influences and special situations.

Typical disturbances include, for example, the sudden depression of the accelerator pedal and consequently a sudden increase in the fuel requirement of the internal combustion engine. The regulation of the fuel delivery system has to compensate quickly for such a load step to ensure optimum operation of the internal combustion engine.

Various devices and methods for operating a fuel delivery system are known in the prior art. For example, it is known to use a Proportional-integral-derivative (PID) regulator, which performs the actuation of the fuel delivery pump to ensure the provision according to requirement of the fuel. A disadvantage of using a simple PID regulator is that the regulation speed and the regulation quality are not optimal.

Furthermore, methods that provide a closed loop with a feedback of the actual value are known. In this case, the determined actual value is fed back into the regulator in order to achieve quicker attainment of a target value. The regulation quality and speed is thereby certainly increased overall, but is still not optimal.

Furthermore, so-called pilot controls, which incorporate further characteristic values of the motor vehicle, are known. For example, the position of the accelerator pedal is taken into consideration. For this purpose, the resulting signal is, for example, offset with the value for actuating the fuel delivery pump, which is predefined by a regulator, in order to obtain improved actuation. The accelerator pedal position may, in this case, be weighted with a weighting factor, which is, for example, rotational-speed-dependent, before the offset with the output value of the regulator is performed. The incorporation of the accelerator pedal position helps to achieve an early influence of the rotational speed of the fuel delivery pump.

In the known devices and methods, to detect the pressure, use is often made of a dedicated pressure sensor, which allows highly accurate and quick detection of the pressure prevailing the fuel delivery system. A disadvantage of the prior art devices and methods is, in particular, that, when using sensor-free detection of the pressure in the fuel delivery system, sufficient regulation quality and regulation speed cannot be achieved since the detection of a change in pressure in the fuel delivery system takes place only with a time delay, and sensor-free detection has overall a higher susceptibility to disturbances.

SUMMARY OF THE INVENTION

It is therefore an object of the present invention to create a method that improves the regulation of a fuel delivery system, wherein in particular the possible disadvantages of sensor-free pressure detection are to be reduced.

This object with regard to the method may be achieved by a method for regulating a fuel delivery system of an internal combustion engine in a motor vehicle, comprising a fuel delivery pump for supplying the internal combustion engine with fuel, wherein the fuel delivery pump has a pump mechanism driveable by an electric motor, wherein the electric motor is actuable by a control signal, and a pressure-sensor-free pressure monitor is provided in the fuel delivery system, wherein a target rotational speed for the electric motor is predefined by the control signal, wherein an upper rotational speed limit and/or a lower rotational speed limit is predefined for the target rotational speed, wherein the upper rotational speed limit depends on the maximum fuel requirement of the internal combustion engine, and the lower rotational speed limit depends on the minimum fuel requirement of the internal combustion engine, and the target rotational speed is determined by a pressure-sensor-free calculation method.

Starting from a present operating state of the internal combustion engine, which is to be understood as an actual state, it is possible to achieve a changed operating state, which is to be understood as a target state, by way of a change in the load requirement or in some other actuation variable of the internal combustion engine. Also, the fuel delivery system may be in an actual state and changed to a target state.

The electric motor used for driving the fuel delivery pump may be run via a corresponding actuation current. The rotational speed of the electric motor is determined by the respectively flowing current. Between the flowing current and the rotational speed that occurs, there are, for each specific pump, fixed relationships that lead to the rotational speed being able to be predefined by a specific current. Thus, with the pressure prevailing in the fuel delivery system taken into consideration, the rotational speed permits a direct indication of the flowing current, and vice versa.

The target rotational speed of the electric motor is predefined in order to achieve a certain fuel delivery at a specific pressure prevailing in the fuel delivery system. The target rotational speed may be determined, for example, with the aid of a characteristic diagram specific to the fuel delivery system. The characteristic diagram presents a direct relationship between the rotational speed of the electric motor or of the pump mechanism of the fuel delivery pump, the pressure prevailing in the fuel delivery system and the delivered volume. With the knowledge of respectively two variables, it is thus possible to determine the third variable. A preferred method makes provision for the pressure in the fuel delivery system to be detected not by a pressure sensor but from the variables delivered volume and rotational speed of the fuel delivery pump. Alternatively, the pressure, in particular the target pressure, in the fuel delivery system may be predefined as a preset value.

Often, the rotational speed of the electric motor also corresponds to the rotational speed of the pump mechanism and thus of the fuel delivery pump. In exceptional cases, in which use is made for example of a gear mechanism between the electric motor and the pump mechanism, the rotational speed may also be larger or smaller by a value that depends on the transmission ratio used.

In the case of a known volume to be conveyed and a known value for the pressure, whether it be through a calculation or through presetting, it is possible to calculate the associated rotational speed. This is particularly advantageous if a target state is to be reached from an actual state, and the rotational speed of the electric motor or of the fuel delivery pump is to be adapted subsequently.

The determination of a target rotational speed in this way is burdened by certain unavoidable inaccuracies, which can lead to the predefined target rotational speed being inaccurate. By the method according to one aspect of the invention, the target range in which the target rotational speed can move is limited in that an upper and a lower rotational speed limit are predefined. Consequently, the certainty of the target value determination is significantly improved, and the occurrence of extreme values is effectively avoided.

The two rotational speed limits are advantageously selected to depend on the fuel requirement of the internal combustion engine. In this case, an actual fuel requirement may preferably be used to determine therefrom the target range for a target rotational speed. Alternatively, it is also possible for predicted requirement values, that is, target fuel requirements, to be used to determine the rotational speed limits. Actual fuel requirements may be determined from different characteristic values generally required for controlling the internal combustion engine. A plurality of such characteristic values is processed, for example, in the engine controller. The fuel requirement of the internal combustion engine is, as a first approximation, identical to the fuel volume delivered by the fuel delivery pump and may therefore be used as a basis for determining a delivery limit. Differences between the actual fuel requirement and the delivered fuel volume can be caused by further consumers, such as, for example, an ejector pump. As a result, the actually delivered fuel quantity normally does not correspond exactly to the fuel requirement of the internal combustion engine. A return delivery of too much delivered fuel into the tank can therefore also take place in some cases.

It is particularly preferable if a change in rotational speed of the electric motor occurs if the determined target rotational speed lies between the determined upper rotational speed limit and the determined lower rotational speed limit.

The actuation of the fuel delivery pump or of the electric motor for producing a change in rotational speed preferably occurs only if the determined target rotational speed lies in the target range predefined by the rotational speed limits. A determined target rotational speed that lies outside the target range is most likely to be erroneous, and regulation toward the target rotational speed is therefore not carried out. This prevents unwanted large or small fuel quantities being delivered, which is advantageous in particular with regard to the energy efficiency of the complete system. The matching between the target range and the determined target rotational speed therefore acts as a safety mechanism.

It is also advantageous if the target fuel volume to be delivered by the fuel delivery pump and the target pressure are used for the determination of the target rotational speed, wherein the target rotational speed is determined with the aid of a characteristic diagram that maps the physical relationship between the rotational speed, the delivered fuel volume and the pressure prevailing in the fuel delivery system.

The target rotational speed of the electric motor or of the fuel delivery pump is preferably determined by way of a comparison with a characteristic diagram. As already mentioned above, the characteristic diagram maps the relationships, for the respective fuel delivery pump, between the pressure, the rotational speed and the delivery volume. The target fuel volume may be deduced for example from the current operating state of the internal combustion engine. The target pressure may, for example, be predefined from outside or provided from a further characteristic diagram.

In a preferred exemplary embodiment, the target rotational speed is formed by a defined rotational speed value reached during the overrun operation of the motor vehicle, wherein, during overrun operation, a fuel volume that depends on the actual load of the internal combustion engine is consumed.

For the case that the motor vehicle is operated in overrun operation, it is advantageous if a defined, constant target rotational speed for the fuel delivery pump is predefined, since also the fuel requirement of the internal combustion engine that then prevails is known precisely and simple adaptation of the delivery power of the fuel delivery pump can thus be achieved. Detection of overrun operation is generally realized in the engine controllers of modern-day motor vehicles, so that a signal can be sent from the unit to the fuel delivery pump, as a result of which the fuel delivery pump implements the predefined overrun operation. Overrun operation means an operating state in which there is no load requirement on the internal combustion engine.

It is also preferable if the upper rotational speed limit is determined from the maximum fuel requirement of the internal combustion engine and a value for the pressure in the fuel delivery system with the aid of a characteristic diagram specific to the respective fuel delivery system and which describes the relationship between the delivered fuel volume, the pressure in the fuel delivery system and the rotational speed of the fuel delivery pump.

Here, the pressure may be both the actual pressure currently prevailing in the fuel delivery system and a predefined or calculated target pressure. It is particularly advantageous if a predefined target pressure is used for determining the rotational speed limit. For example, the target pressure may be read off empirically or experimentally determined tables of values. Also, the target pressure may be determined from characteristic values from the engine controller and used as a preset value for the calculation of the rotational speed limit. For the calculation, the maximum possible fuel requirement of the internal combustion engine is preferably used in order to contain the target range for a target rotational speed to be determined.

It is furthermore advantageous if the lower rotational speed limit is determined from the minimum fuel requirement of the internal combustion engine and a value for the pressure in the fuel delivery system with the aid of a characteristic diagram specific to the respective fuel delivery system and which describes the relationship between the delivered fuel volume, the pressure in the fuel delivery system and the rotational speed of the fuel delivery pump.

To determine the lower rotational speed limit, it is likewise possible to use empirically or experimentally determined values or other preset values for the target pressure. Additionally, the use of the minimum possible fuel requirement is preferred for the target range for the target rotational speed to be bounded below.

It is furthermore advantageous if, to determine the rotational speed limits, actual fuel requirements of the internal combustion engine and/or target fuel requirements of the internal combustion engine are used, and actual pressures in the fuel delivery system and/or target pressures in the fuel delivery system are used.

Depending on the available values, both target values and actual values may be used for the fuel requirement of the internal combustion engine and for the pressure in the fuel delivery system. Use of values that respectively have greater accuracy or correspond better to the operating state to be achieved is particularly advantageous. Depending on the method of determination, both the actual values and the target values may be burdened by inaccuracies. Particularly preferably, the respectively more accurate values are used for the determination of the rotational speed limits.

It is also expedient if the value for the pressure in the fuel delivery system, which value is used for determining the rotational speed limits, is a preset value determined from the characteristic values of the internal combustion engine and/or of the motor vehicle. The presetting of a value for the pressure is in particular advantageous if, as in the method according to the invention, no dedicated pressure sensor is used, and thus no continuous, measurement-technology-based monitoring of the pressure takes place.

It is furthermore advantageous if, with the aid of characteristic values that describe the operating state of the internal combustion engine, the maximum actual fuel requirement of the internal combustion engine and/or the minimum actual fuel requirement of the internal combustion engine and/or the actual fuel requirement of the internal combustion engine is determined during overrun operation of the motor vehicle. In order to operate an internal combustion engine, a multiplicity of different values are collected and processed by the vehicle electronics. These values also advantageously allow the respectively minimum fuel requirement and the maximum fuel requirement to be determined. This allows particularly accurate and simple determination of the fuel requirement.

In order to determine the actual fuel requirement of the internal combustion engine, it is particularly expedient if the accelerator pedal position and/or the boost pressure of a turbocharger and/or the rotational speed of the internal combustion engine and/or the delivered air mass and/or the fuel/air ratio in the internal combustion engine and/or the lambda value and/or the air temperature is used for the determination.

It is also advantageous if the fuel requirement of the internal combustion engine is corrected by an offset volume, wherein the offset volume represents an additional fuel requirement owing to fuel-receiving elements contained in the fuel delivery system. The offset volume is added to the fuel requirement of the internal combustion engine, which results in a nominally higher fuel requirement. This follows from the fact that the fuel delivery pump has to deliver not only the fuel for the internal combustion engine, but also the offset volume needed, for example, for the operation of an ejector pump. The offset volume can be added both to the actual fuel requirement and to a predicted target fuel requirement.

It is furthermore to be preferred if calibration of the fuel delivery system takes place, wherein the actual fuel volume, which is determined from an actual rotational speed and an actual pressure by a characteristic diagram, is entered into an inverse characteristic diagram, which is produced by switching the axes of the characteristic diagram used, wherein a comparison rotational speed and/or a comparison pressure is determined from the inverse characteristic diagram, wherein, in each case, a deviation between the actual rotational speed and the comparison rotational speed and/or between the actual pressure and the comparison pressure is determined.

The calibration is advantageous to ensure operation of the fuel delivery system, which is as precise as possible. It is possible for the calibration to occur with the aid of characteristic diagrams, wherein, for example, the fuel delivery volume is determined from the known rotational speed and the known pressure. For this purpose, a characteristic diagram specific to the fuel delivery system is used. The use of a so-called inverse characteristic diagram, essentially produced by switching the X-axis and the Y-axis of the original characteristic diagram, allows a back calculation to the pressure or the rotational speed to be performed on the basis of the previously determined volume and respectively one of the values pressure or rotational speed. The deviations established in this case may be used for the calibration of the fuel delivery system.

It is furthermore advantageous if the determination of the rotational speed limits for the target rotational speed takes place continuously. This allows continuous correction or error-checking of the target rotational speed which has been determined by the pressure-sensor-free determination. If the determined rotational speed lies outside the determined window for the target rotational speed, an erroneous calculation of the rotational speed may, for example be, present. This information about an erroneous target rotational speed is useful in order for example to avoid the actuation of the electric motor or of the fuel delivery pump with an incorrect preset value.

It is also to be preferred if the target rotational speed calculated in the pressure-sensor-free calculation method is matched with the determined rotational speed limits, wherein the determined target rotational speed is adapted to a value inside the rotational speed limits if the determined target rotational speed lies outside the rotational speed limits. This is advantageous to obtain in any case a valid target rotational speed inside the rotational speed limits. Depending on whether the target rotational speed is above the upper limit or below the lower limit, a respectively suitable adaptation can be carried out. For the purpose of adjusting the target rotational speed, it is possible for a characteristic diagram or another presetting to be stored in the fuel delivery system.

The adaptation may alternatively occur by way of a calculation algorithm, which carries out an adaptation depending on the operational situation.

Advantageous refinements of the present invention are described in the claims and in the following description of the figures.

BRIEF DESCRIPTION OF THE DRAWINGS

In the following text, the invention will be explained in detail on the basis of exemplary embodiments with reference to the drawings, in which.

DETAILED DESCRIPTION OF THE PRESENTLY PREFERRED EMBODIMENTS

Figure 1:
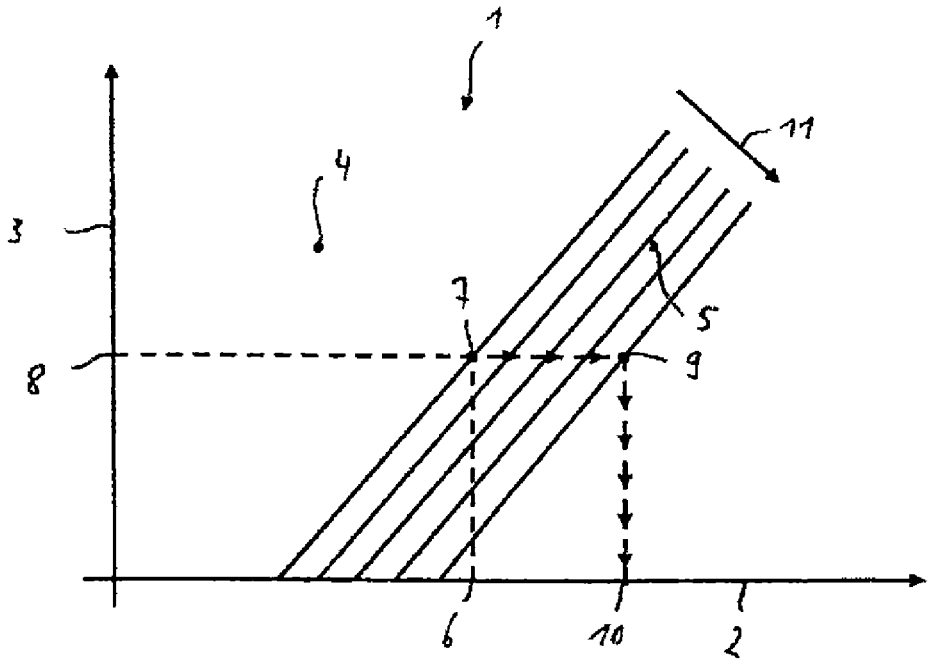
FIG. 1 shows a characteristic diagram illustrates the delivered volume against the rotational speed, wherein curves of equal pressure are illustrated in the characteristic diagram.

FIG. 1 is a characteristic diagram 1 illustrating the relationships between the volume delivered by the fuel delivery pump, the rotational speed of the fuel delivery pump and the pressure in the fuel delivery system. The rotational speed is plotted on the X-axis, which is denoted with the reference numeral 2. The delivery volume of the fuel delivery pump is plotted on the Y-axis, which is denoted with the reference numeral 3. In the quadrant 4 spanned by the axes 2, 3, a plurality of curves 5 is illustrated. The curves 5 are isobars and thus describe ranges of constant pressure. The characteristic diagram 1 is specific to a specific fuel delivery system. The characteristic diagram changes depending on, inter alia, the fuel delivery pump used, the lines used and many other factors. Qualitatively, however, the characteristic diagrams for the three described variables always look like the characteristic diagram 1 illustrated in FIG. 1.

On the basis of the characteristic diagram 1, if two variables are known, it is possible to determine the respective third variable. Starting from a known rotational speed, which may be given, for example, by the rotational speed 6, at a known pressure 7, the associated delivery volume 8 can be determined. Furthermore, for a constant delivery volume 8 at a changed pressure 9, it is then also possible for a changed, associated rotational speed 10 to be determined. This is appropriate, for example, if a known delivery volume 8 is to be delivered at an increased pressure 9 since the required rotational speed 10 can be determined easily in this way.

The pressure 7, 9 in the fuel delivery system increases along the arrow 11. For the purpose of checking and/or calibrating values, it is also possible for a so-called inverse characteristic diagram to be used, wherein in the case of the inverse characteristic diagram, the X-axis 2 and the Y-axis 3 are transposed. For the purpose of calibration, starting from two known values, it is possible for the respectively missing third value to be determined. With knowledge of the third determined value, it is then possible, with the aid of a known second value, for the still unknown value of the three values to be deduced in the inverse characteristic diagram or in reverse in the characteristic diagram 1. The latter value can then be matched with the actually measured value, and, on the basis of the difference that sometimes occurs, calibration can be carried out.

Figure 2:
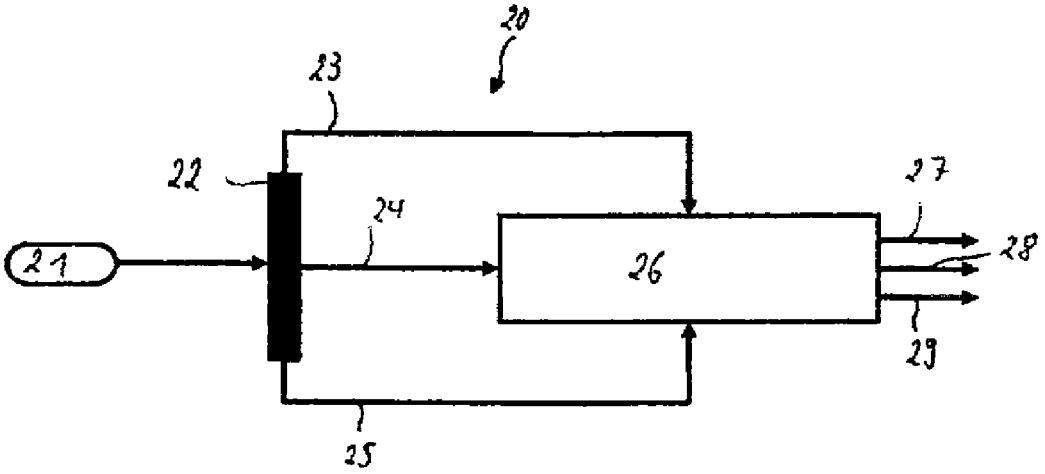
FIG. 2 shows a block diagram of a stoichiometry module for determining the fuel requirement of an internal combustion engine.

FIG. 2 shows a block diagram 20. The block 21 represents an interface to the remaining motor vehicle. Various pieces of information in the form of characteristic values can be taken from the block 21. In the example of FIG. 2, output from the distributor block 22 are the characteristic values target pressure via the signal line 23, the accelerator pedal position via the signal line 24, and the boost pressure of the turbocharger via the signal line 25. In alternative configurations, other values may also be used, additionally or alternatively. These include in particular different temperatures, the fuel/air ratio, the motor rotational speed or the measurement values of the lambda probe.

The block 26 forms a so-called stoichiometry module. The fuel requirement is calculated in the block 26 on the basis of the characteristic values from the block 21 or 22. For example, the minimum fuel requirement, the maximum fuel requirement and a fuel requirement for the overrun operation may be determined. Output from the stoichiometry module 26 via the signal line 27 is the currently maximum possible fuel requirement, via the signal line 28 is the currently minimum possible fuel requirement and via the signal line 29 is the fuel requirement during the overrun operation of the motor vehicle. The different fuel requirements may subsequently be processed to form further characteristic values.

The stoichiometry module 26 serves in particular for determining the possible fuel requirement of the internal combustion engine with the aid of characteristic values which originate directly from the operation of the internal combustion engine.

The block diagram shown in FIG. 2 is illustrated again in Figure as part of the block diagram illustrated there. Here, the reference signs are retained for identical elements.

Figure 3:
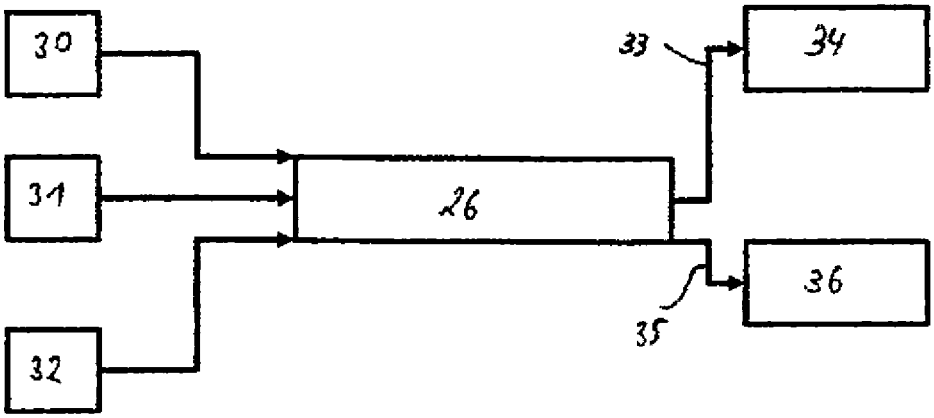
FIG. 3 shows an exemplary use of a stoichiometry module as it is already shown in FIG. 2.

FIG. 3 shows a stoichiometry module 26, as it has been shown already in FIG. 2. FIG. 3 reflects a specific application for a particular operational situation of the internal combustion engine. The rotational speed 30 of the internal combustion engine, the accelerator pedal position 31 of the motor vehicle and the boost pressure 32 of the turbocharger installed at the internal combustion engine are passed into the stoichiometry module 26. A value for the fuel requirement of the internal combustion engine is passed on to an output display 34 via the signal line 33. The value indicated on the display 34 is the maximum fuel requirement of the internal combustion engine in the situation considered. A second value is output to the second display 36 via the signal line 35. The value corresponds to the minimum fuel requirement of the internal combustion engine in the situation considered.

The values output on the displays 34 and 36 always relate to the input variables coming from the blocks 30, 31 and 32. The maximum and the minimum fuel requirement thus constantly relate to the operating state of the internal combustion engine that prevailed at the moment of acquisition of the input variables coming from the blocks 30, 31 and 32.

Figure 4:
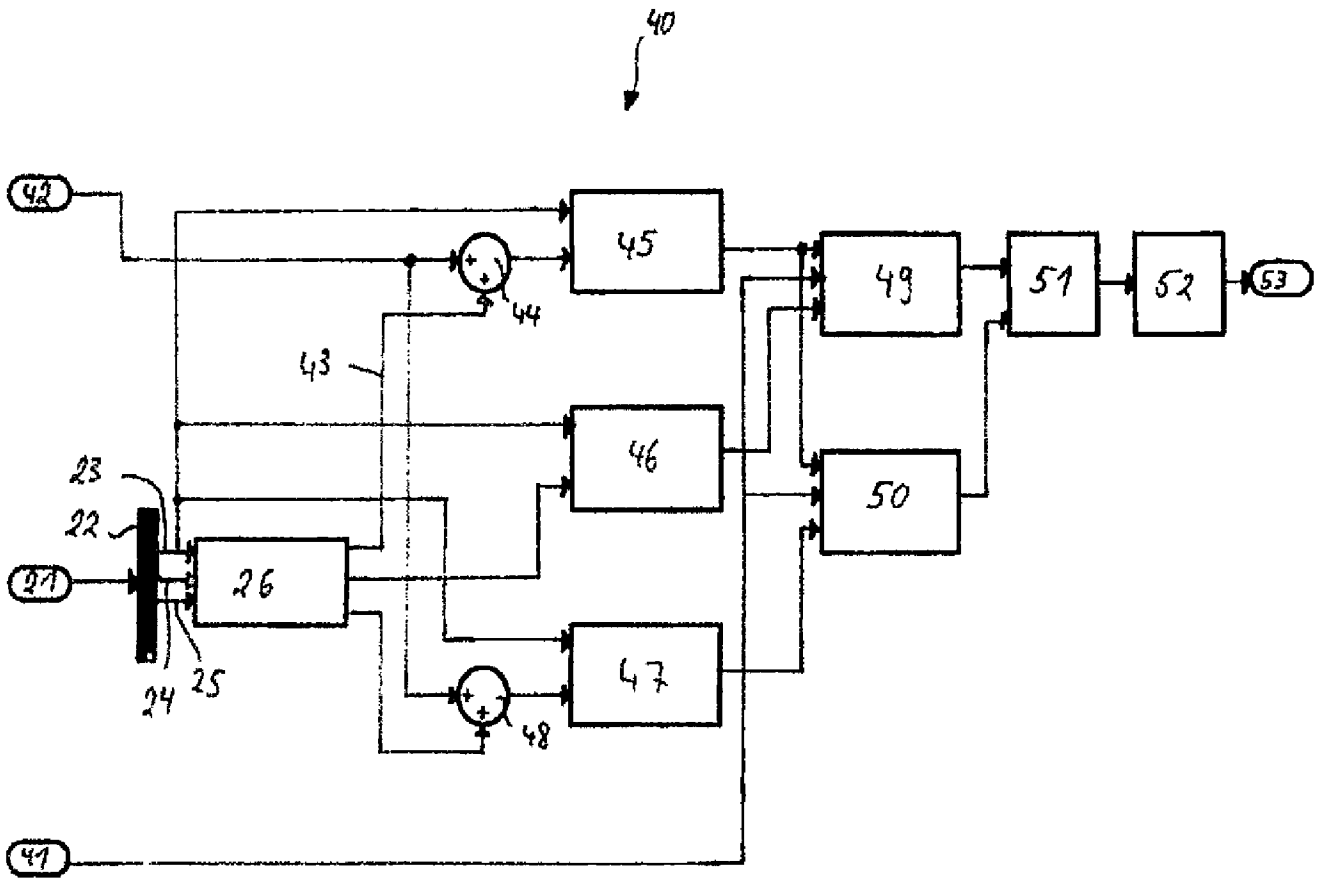
FIG. 4 shows a block diagram that illustrates one possible embodiment of the method according to the invention.

FIG. 4 shows a block diagram 40. The stoichiometry module from FIG. 2 is shown by the reference sign 26. Identical elements are provided with the same reference signs. In addition to the input variables, which originate from the motor vehicle via block 21, the rotational speed of the fuel delivery pump, in particular the target rotational speed, is provided as an input variable via the block 41. The target rotational speed 41 may be determined via a pressure-sensor-free method and serves for the adaptation of the fuel volume delivered by the fuel delivery pump.

Furthermore, an offset volume is introduced via block 42. The offset volume represents an additional volume that has to be delivered in addition to the fuel volume required by the internal combustion engine by the fuel delivery pump in order to ensure fault-free operation of the fuel delivery system. The offset volume may be required, for example, for the operation of an ejector pump.

The currently maximum fuel requirement of the internal combustion engine is output from the stoichiometry module 26 via the signal line 43. This is added to the offset volume in the summation block 44 and entered into the block 45.

Additionally, a presetting for a target pressure to be reached in the fuel delivery system is also passed into the block 45, which target pressure is branched off from the signal line 23.

The target pressure coming from the signal line 23 is likewise entered into the block 46. Additionally, the currently minimum fuel requirement is passed into the block 46 via the signal line 47. The minimum fuel requirement is not offset with the offset volume since the actually minimum fuel requirement of the internal combustion engine goes into the block 46 for further processing. In an alternative configuration, it is also possible, however, for the minimum fuel requirement to be offset with the offset volume.

The target pressure from the signal line 23 likewise goes into the block 47. Moreover, during overrun operation, the fuel requirement, which is output from the stoichiometry module 26 along the signal line 49, goes into the block 47. Before the block 47, the fuel requirement in overrun operation is, in the summation block 48, likewise offset with the offset volume from block 42.

In the blocks 45, 46 and 47, a rotational speed presetting is then determined from the target pressure and the respectively determined fuel volume, the latter of which is composed of the respective fuel requirement and if appropriate the offset volume, in each case with the aid of characteristic diagrams, as they are illustrated for example in FIG. 1. The upper rotational speed limit is determined from the block 45, and the lower rotational speed limit is determined from block 46. These two rotational limits span a target range for a target rotational speed for the fuel delivery pump. A rotational speed presetting, which is used as a target rotational speed in particular if the motor vehicle is in overrun operation, is determined in block 47.

Not only the rotational speed limits determined in the blocks 45 and 46 but also the target rotational speed from the block 41 go into the block 49. A check as to whether or not the target rotational speed lies inside the rotational speed limits takes place in block 49. If the target rotational speed lies inside the limits, the fuel delivery pump is subsequently regulated to the determined target rotational speed.

In addition to the target rotational speed from block 41 and the rotational speed presetting for the overrun operation from block 47, the upper rotational speed limit from block 45 also goes into the block 50. In this way, it is possible to check whether the target rotational speed, predefined during overrun operation, for the fuel delivery pump is below the upper rotational speed limit, and by how much the target rotational speed from block 41 if appropriate differs from the rotational speed determined in the block 47. Adaptation of the rotational speed determined in block can take place in block 50. Alternatively, the target rotational speed determined from block 41 can be adapted, or some other processing can be performed.

Finally, a target rotational speed is output from both the block 49 and from the block 50, which speed, in the case of the block 49, in any case lies inside the rotational speed limits. A target rotational speed lying outside the rotational speed limits either is not passed, or is on correspondingly corrected to a value inside the rotational speed limits, by the block 49.

A check as to whether the motor vehicle or the internal combustion engine actually being operated in overrun operation takes place in the block 51. If this is the case, the target rotational speed coming from the block 50 is output from the block 51. If overrun operation is not present, the target rotational speed determined in the block 49 is output from block 51.

In the block 52 connected downstream, there may occur a weighting of the target rotational speed or a signal conversion into a format that is suitable for the actuation of the fuel delivery pump or of the associated electric motor. The determined target rotational speed is then passed as a control signal to the fuel delivery pump or to the electric motor of the fuel delivery pump via the block 53.

FIG. 4 shows an exemplary embodiment of a block diagram for realizing a method according to the invention. The illustration of FIG. 4 is in particular not of a restrictive nature and does not exclude possible solutions that are not explicitly shown.

The exemplary embodiments of FIGS. 1 to 3 are also in particular not of a restrictive nature, and serve for illustrating the concept of the invention.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for regulating a fuel delivery system of an internal combustion engine in a motor vehicle having a fuel delivery pump for supplying the internal combustion engine with fuel, the fuel delivery pump having a pump mechanism driveable by an electric motor actuable by a control signal, and a pressure-sensor-free pressure monitor being provided in the fuel delivery system, the method comprising:

predefining a target rotational speed for the electric motor based on the control signal;

predefining an upper rotational speed limit and/or a lower rotational speed limit for the target rotational speed, wherein the upper rotational speed limit depends on the maximum fuel requirement of the internal combustion engine, and the lower rotational speed limit depends on the minimum fuel requirement of the internal combustion engine;

determining the target rotational speed by a pressure-sensor-free calculation method; and calibrating the fuel delivery system by:

determining an actual fuel volume based on an actual rotational speed and an actual pressure based on a first characteristic diagram, and entering the determined actual fuel volume into an inverse characteristic diagram, produced by switching the axes of the first characteristic diagram.

2. The method as claimed in claim 1, further comprising changing the rotational speed of the electric motor if the determined target rotational speed lies between the determined upper rotational speed limit and the determined lower rotational speed limit.

3. The method as claimed in claim 1, wherein the target rotational speed is formed by a defined rotational speed value reached during an overrun operation of the motor vehicle, wherein, during the overrun operation, a fuel volume that depends on the actual load of the internal combustion engine is consumed.

4. The method as claimed in claim 1, wherein the rotational speed limits are determined based upon:

actual fuel requirements of the internal combustion engine and/or target fuel requirements of the internal combustion engine; and actual pressures in the fuel delivery system and/or target pressures in the fuel delivery system.

5. The method as claimed in claim 1, wherein a value for a pressure in the fuel delivery system is used for determining the rotational speed limits, a value for pressure in the fuel delivery system being a preset value determined from characteristic values of the internal combustion engine and/or of the motor vehicle.

6. The method as claimed in claim 1, further comprising determining, during overrun operation of the motor vehicle, a maximum actual fuel requirement of the internal combustion engine and/or a minimum actual fuel requirement of the internal combustion engine and/or the actual fuel requirement of the internal combustion engine based on characteristic values that describe an operating state of the internal combustion engine.

7. The method as claimed in claim 1, further comprising correcting a fuel requirement of the internal combustion engine based on an offset volume, wherein the offset volume represents an additional fuel requirement of fuel-receiving elements in the fuel delivery system.

8. The method as claimed in claim 1, the calibrating of the fuel delivery system further comprising:

determining a comparison rotational speed and/or a comparison pressure based on the inverse characteristic diagram; and determining a deviation between the actual rotational speed and the comparison rotational speed or between the actual pressure and the comparison pressure.

9. The method as claimed in claim 1, further comprising:

matching the target rotational speed calculated in the pressure-sensor-free calculation method with the determined rotational speed limits; and adapting the determined target rotational speed to a value inside the rotational speed limits if the determined target rotational speed lies outside the rotational speed limits.

10. A method for regulating a fuel delivery system of an internal combustion engine in a motor vehicle having a fuel delivery pump for supplying the internal combustion engine with fuel, the fuel delivery pump having a pump mechanism driveable by an electric motor actuable by a control signal, and a pressure-sensor-free pressure monitor being provided in the fuel delivery system, the method comprising:

predefining a target rotational speed for the electric motor based on the control signal;

predefining an upper rotational speed limit and/or a lower rotational speed limit for the target rotational speed, wherein the upper rotational speed limit depends on the maximum fuel requirement of the internal combustion engine, and the lower rotational speed limit depends on the minimum fuel requirement of the internal combustion engine; and determining the target rotational speed by a pressure-sensor-free calculation method, wherein a target fuel volume to be delivered by the fuel delivery pump and a target pressure are used for the determination of the target rotational speed, wherein the target rotational speed is determined based on a characteristic diagram that maps a physical relationship between the rotational speed, the delivered fuel volume and a pressure prevailing in the fuel delivery system.

11. A method for regulating a fuel delivery system of an internal combustion engine in a motor vehicle having a fuel delivery pump for supplying the internal combustion engine with fuel, the fuel delivery pump having a pump mechanism driveable by an electric motor actuable by a control signal, and a pressure-sensor-free pressure monitor being provided in the fuel delivery system, the method comprising:

predefining a target rotational speed for the electric motor based on the control signal;

predefining an upper rotational speed limit and/or a lower rotational speed limit for the target rotational speed, wherein the upper rotational speed limit depends on the maximum fuel requirement of the internal combustion engine, and the lower rotational speed limit depends on the minimum fuel requirement of the internal combustion engine;

determining the target rotational speed by a pressure-sensor-free calculation method; and determining the upper rotational speed limit based on:

a maximum fuel requirement of the internal combustion engine;

a value for pressure in the fuel delivery system; and a characteristic diagram specific to a respective fuel delivery system and that describes a relationship between a delivered fuel volume, the pressure in the fuel delivery system and a rotational speed of the fuel delivery pump.

12. A method for regulating a fuel delivery system of an internal combustion engine in a motor vehicle having a fuel delivery pump for supplying the internal combustion engine with fuel, the fuel delivery pump having a pump mechanism driveable by an electric motor actuable by a control signal, and a pressure-sensor-free pressure monitor being provided in the fuel delivery system, the method comprising:

predefining a target rotational speed for the electric motor based on the control signal;

predefining an upper rotational speed limit and/or a lower rotational speed limit for the target rotational speed, wherein the upper rotational speed limit depends on the maximum fuel requirement of the internal combustion engine, and the lower rotational speed limit depends on the minimum fuel requirement of the internal combustion engine;

determining the target rotational speed by a pressure-sensor-free calculation method; and determining the lower rotational speed limit based on:

a minimum fuel requirement of the internal combustion engine;

a value for pressure in the fuel delivery system; and a characteristic diagram specific to a respective fuel delivery system and that describes a relationship between a delivered fuel volume, the pressure in the fuel delivery system and a rotational speed of the fuel delivery pump.

* * * * *